US011231232B2

(12) United States Patent
Flesch et al.

(10) Patent No.: US 11,231,232 B2
(45) Date of Patent: Jan. 25, 2022

(54) HEAT EXCHANGER

(71) Applicant: Mahle International GmbH, Stuttgart (DE)

(72) Inventors: Carsten Flesch, Tamm (DE); Florian Gruber, Stuttgart (DE); Jens Ruckwied, Stuttgart (DE); Sven-Fabian Zeh, Benningen (DE)

(73) Assignee: Mahle International GmbH

( * ) Notice: Subject to any disclaimer, the term of this patent is extended or adjusted under 35 U.S.C. 154(b) by 15 days.

(21) Appl. No.: 16/833,428

(22) Filed: Mar. 27, 2020

(65) Prior Publication Data

US 2020/0340749 A1 Oct. 29, 2020

(30) Foreign Application Priority Data

Mar. 29, 2019 (DE) ..... 102019108213.7

(51) Int. Cl.
*F28F 9/02* (2006.01)
*F28D 7/00* (2006.01)

(52) U.S. Cl.
CPC ..... *F28D 7/0041* (2013.01)

(58) Field of Classification Search
CPC ..... F28D 7/0041
USPC ..... 165/175
See application file for complete search history.

(56) References Cited

U.S. PATENT DOCUMENTS 6,932,950 B1 8/2005 Guetlhuber
2009/0266104 A1* 10/2009 Ichiyanagi ..... F28F 9/0209 62/498
2010/0122793 A1 5/2010 Wolfe, IV et al.
2012/0024611 A1* 2/2012 Ajisaka ..... B60K 11/08 180/68.1
2015/0060028 A1* 3/2015 Irmler ..... F28D 7/1638 165/157
2016/0363380 A1* 12/2016 Siegel ..... F28D 7/16

FOREIGN PATENT DOCUMENTS

DE 8520845 U1 8/1985
DE 19806810 A1 8/1999
DE 102009049282 A1 1/2011
EP 0112513 A2 7/1984
EP 1635131 A1 3/2006
EP 3354998 A1 8/2018

OTHER PUBLICATIONS

English abstract for DE-102009049282.

* cited by examiner

*Primary Examiner* — Davis D Hwu
(74) *Attorney, Agent, or Firm* — Fishman Stewart PLLC

(57) ABSTRACT

The present disclosure describes a heat exchanger of a motor vehicle that is supplied with a cooling air mass flow that changes depending on a travelling speed of the motor vehicle. The heat exchanger includes a heat exchanger block with a plurality of flat tubes that are each received on a longitudinal end side in an associated passage opening of a tube sheet and provide a coolant path. A tank is connected to the tube sheet and defines a coolant header. An additional element is arranged on an outer edge or on an outer marginal region of the tube sheet. The additional element is structured and arranged to provide an at least partial covering of the tube sheet relative to an inflow side, e.g., relative to the cooling air mass flow.

20 Claims, 3 Drawing Sheets

HEAT EXCHANGER

CROSS-REFERENCE TO RELATED APPLICATION

This application claims priority to German Patent Application No. DE 10 2019 108 213.7 filed Mar. 29, 2019, the contents of which are hereby incorporated by reference in its entirety.

TECHNICAL FILED

The present invention relates to a heat exchanger having a heat exchanger block with flat tubes, which are received in each case on the longitudinal end side in associated passage openings of a tube sheet and form a coolant path. In addition, the present invention relates to an internal combustion engine having such a heat exchanger.

BACKGROUND

Generic heat exchangers are thoroughly known and today are installed in almost every motor vehicle with internal combustion engine. Such a heat exchanger comprises a multiplicity of flat tubes, between which heat exchanger elements, such as for example corrugated fin plates are arranged and which, alternately with the heat exchanger elements, are stacked on top of one another. A stack formed in this way is closed on both sides by lateral parts, which together with the flat tubes are fixed in each case on or in a tube sheet on the longitudinal end side. Together with a box, the tube sheet forms a coolant header, so that a part of a coolant path materialises from the one coolant header through the flat tubes to the other coolant header. The air cooling the coolant flows through orthogonally between the flat tubes. Usually, the flat tubes themselves are folded and/or welded from aluminium sheet and generally comprise at least one fold or a web, which divides a flow passage for the coolant in the flat tube into at least two chambers.

The alternating thermal load is dependent, among other things, on the temperature differential between the fold or web of the flat tubes and an outer marginal region or outer edge of the tube sheet enclosing the flat tubes on the end side. The higher the temperature differential is, the higher are also the stresses acting on the fold or the web. While travelling, the temperature of the outer marginal region or of the outer edge of the tube sheet changes as a function of the respective travelling speed and at the same time of geometrical conditions in an engine compartment of the motor vehicle. By contrast, the temperature of the fold or web region of the flat tubes frequently remains relatively constant on a coolant inlet side since the heat exchanger is generally supplied with a low constant leakage flow of hot coolant.

Through the change of the temperature of the tube sheet with relatively constant temperature of the fold or web region of the flat tubes, a local temperature gradient between these two regions develops in particular on a coolant inlet side of the heat exchanger which has the consequence that through the different heat expansions of the components tube sheet and flat tube that are firmly connected to one another, thermal loads can develop. The fold or web region of the flat tubes is subjected to compressive stresses upon cooling and thermal contraction of the surrounding tube sheet, as a consequence of which cracks can develop in the thin wall material of the flat tubes, which with sufficiently frequent and high loading can ultimately result in a coolant leakage and thus the failure of the heat exchanger, which has to be avoided at all cost.

SUMMARY

The present invention therefore deals with the problem of stating an improved or at least an alternative embodiment for a heat exchanger of the generic type, with which in particular the temperature gradient that occurs between flat tubes and tube sheet during the operation can be reduced and thus the disadvantages known from the prior art avoided.

According to the invention, this problem is solved through the subject of the independent claim(s). Advantageous embodiments are subject of the dependent claims.

The present invention is based on the general idea of protecting a marginal edge or an outer edge region of a tube sheet of a heat exchanger in a motor vehicle by means of an additional element from a direct headwind inflow, thereby achieving a comparatively constant temperature there, as a result of which a temperature gradient between this outer edge or outer marginal region and a fold or web of a flat tube can be kept comparatively low.

The temperature in the fold or web region of the flat tube is relatively constant in particular since there is always a certain coolant leakage flow. However in a heat exchanger installed in a motor vehicle, the outer marginal region or outer edge of the tube base is exposed to a different headwind and thus cooling air mass flow depending on the travelling speed, as a result of which a comparatively large temperature gradient between this outer edge and the fold or web region of the flat tube can develop. The heat exchanger according to the invention comprises a heat exchanger block with the previously mentioned flat tubes, which in each case are received on the longitudinal end side in associated passage openings, for example through-feeds, of a tube sheet and form a part of a coolant path. A tank is connected to the respective tube sheet in each case, wherein a tube sheet each and a tank connected to the same, form a coolant header. According to the invention, an additional element is now arranged on an outer edge or an outer marginal region of the tube sheet, which brings about an at least partial coverage of the tube sheet relative to at least one inflow side, i.e. relative to the cooling air mass flow. Because of this, a headwind-dependent severe cooling of the tube sheet can be reduced in particular.

In an advantageous further development of the invention, the additional element is designed as heat insulation and/or as shielding element, which shields the outer edge or the outer marginal region of the tube sheet. Both by means of the heat insulation and also by means of the shielding element, a direct contact with the headwind, i.e. a direct flow onto the outer edge or the outer marginal region of the tube sheet can be avoided. Thus, the temperature gradient between this outer edge or outer marginal region of the tube sheet and the fold or web region of the flat tubes is kept low. Because of this, thermally-induced stresses on the flat tubes can be reduced in particular and because of this the lifespan of the heat exchanger extended. The heat insulation or the shielding element is preferentially provided at least in the region of that tube sheet via which coolant enters the flat tubes. Obviously, such a heat insulation and/or a shielding element can also be arranged on the other coolant header.

In an advantageous further development of the solution according to the invention, an additional element as heat insulation of an open-pore or a closed-pore foam material is arranged on the outer edge or on the outer marginal region of the tube sheet. Such a foam material brings about an insulating layer and prevents a direct flow of the headwind onto the outer edge or the outer marginal region of the tube sheet, as a result of which the same has significantly lower temperature fluctuations at different travelling speeds. Such a foam can be for example a foam material or any other insulating material which merely has to be able to withstand the coolant temperatures that occur in the region of the respective tube sheet.

Practically, an additional element designed as heat insulation is arranged on the outer edge or on the outer marginal region of the tube sheet, which is glued, clamped or moulded onto the tube sheet. Bonding the heat insulation to the respective outer edge of the tube sheet offers the major advantage of a comparatively simple and quick assembly. This advantage is likewise offered with a clamping of the heat insulation to the tube sheet. A further alternative embodiment is conceivable by injection-moulding the heat insulation to the outer edge or outer marginal region of the tube sheet, since in this case an incorporation of the production of the heat insulation in the manufacturing process, in particular automated manufacturing process, is possible.

In a further advantageous embodiment of the solution according to the invention, an additional element designed as heat insulation is exclusively arranged on an inflow side on the outer edge or on the outer marginal region of the tube sheet, or completely circulating about the outer edge or the outer edge of the tube sheet. In particular the inflow side should be covered by means of such a heat insulation since this is where the temperature reduction due to the headwind (cooling air mass flow) is greatest. On the outlet side, the air already has a significantly higher temperature and hardly results in any (headwind) flowing onto the outer edge or the outer marginal region of the tube sheet, but only in a flowing past of the same.

In a further advantageous embodiment of the solution according to the invention, the additional element is a shielding element which is connected to the tank of the coolant header and projects over the outer edge of the tube sheet, in particular in the direction of the heat exchanger block. The shielding element is arranged spaced apart from the outer edge of the tube sheet and merely brings about an air deflection element, so that the headwind can no longer directly flow onto and thus directly cool the outer marginal region or the outer edge of the tube sheet. Such a shielding element is connected to the tank of the coolant header in as simple as possible a mountable manner, for example by way of a plug connection, an snap-in connection, a bonded connection or a screwed connection.

Practically, heat exchanger elements, in particular corrugated fins are arranged between the flat tubes which are arranged spaced apart by a distance a to the respective tube sheet so that in this distance a, in which between two adjacent flat tubes no heat exchanger element is arranged, a cooling air bypass path is created purely theoretically. Practically, the shielding element therefore projects beyond the distance a into the heat exchanger block and thereby covers the cooling air bypass present within this distance a. By way of this, this cooling air bypass is covered and the cooling airflow resulting from the headwind directed through the heat exchanger elements, as a result of which, in addition to the desired function of a reduced alternating thermal load, an improved cooling effect is additionally achieved.

Further important features and advantages of the invention are obtained from the subclaims, from the drawing and from the associated figure description by way of the drawing.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference numbers relate to same or similar or functionally same components.

BRIEF DESCRIPTION OF THE DRAWINGS

There it shows, in each case schematically.

DETAILED DESCRIPTION

Figure 1:
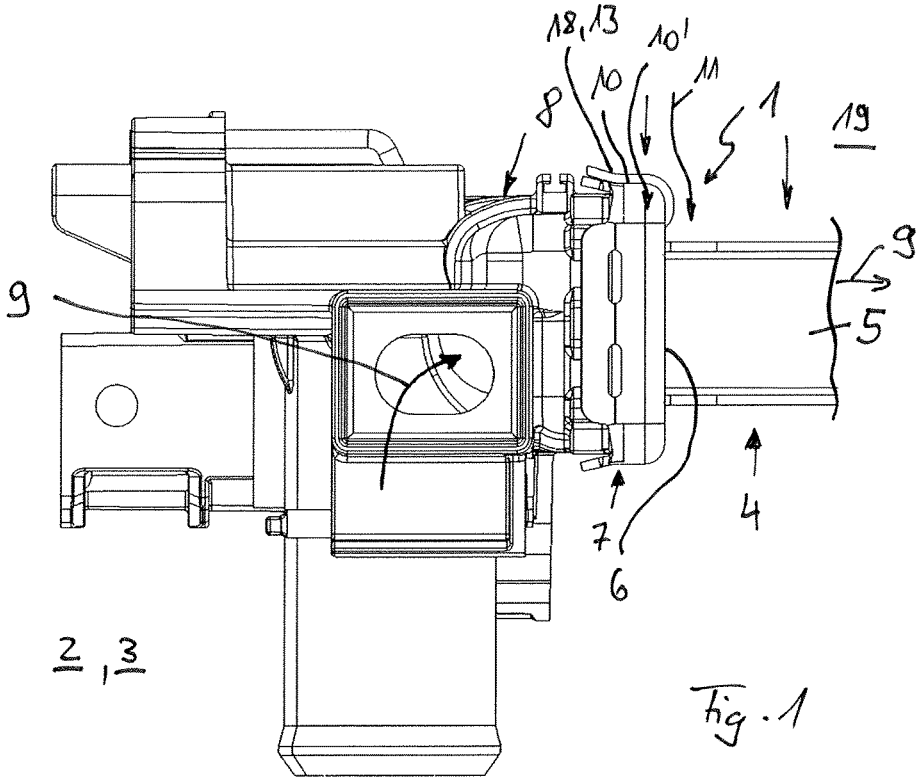
FIG. 1 a view of a heat exchanger according to the invention with a heat insulation and an outer edge of a tube sheet, FIG. 2 a representation as in FIG. 1, however in an oblique view, FIG. 3 a representation as in FIG. 1, however with a shielding element, FIG. 4 a representation as in FIG. 3, however in an oblique view, FIG. 5 a view of a tube sheet with a flat tube received therein.
Figure 2:
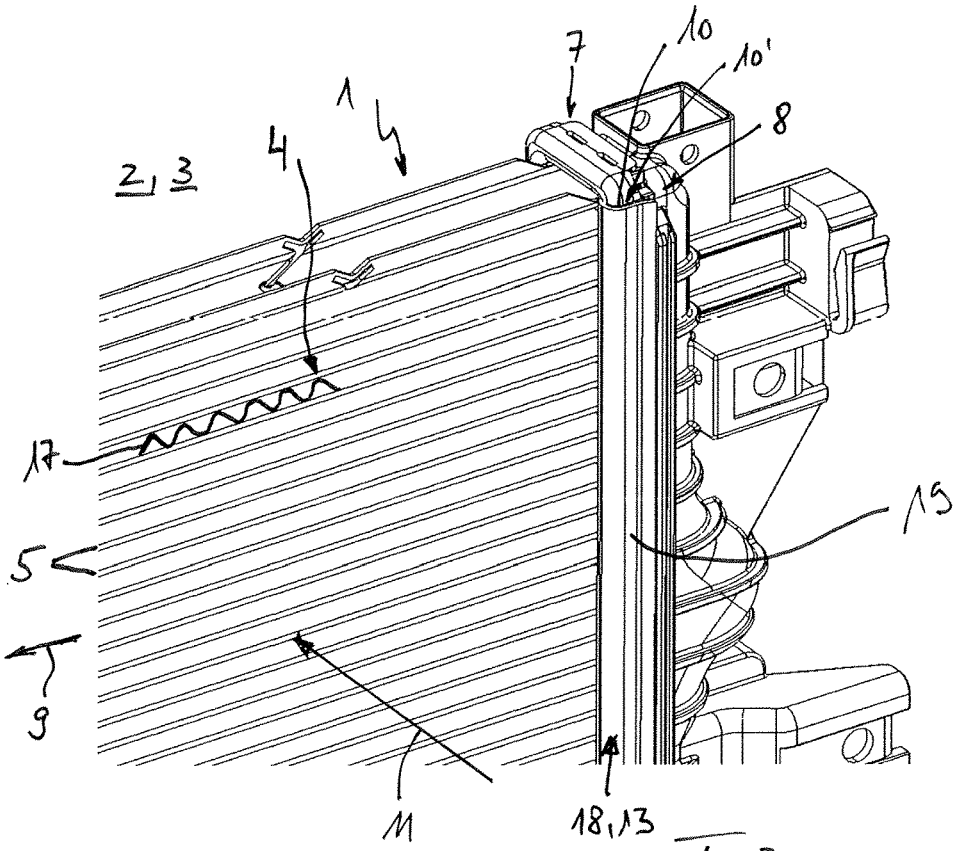

According to FIGS. 1 to 4, a heat exchanger 1 according to the invention, in particular for an internal combustion engine 2 in a motor vehicle 3, comprises a heat exchanger block 4 with flat tubes 5, which are each received on the longitudinal end side in associated passage openings 6 (see also FIG. 5) of a tube sheet 7 and form a coolant path. Likewise provided is a tank 8, which is tightly connected to the respective tube sheet 7 and forms a coolant header. The tank 8 shown according to FIGS. 1 to 4 and the respective associated tube sheet 7 form a distributor tank, so that by way of this coolant header, coolant 9 flows into the flat tubes 5. In order to now be able to at least reduce a comparatively intensive cooling of an outer edge 10 or of an outer marginal region 10' of the tube sheet 7, caused by a cooling air mass flow 11 (headwind) and thus a comparatively large temperature gradient between the outer edge 10 or the outer marginal region 10' of the tube sheet 7 and a fold or web region 12 (see FIG. 5) of the flat tubes 5, an additional element 18 is arranged on the outer edge 10 or the outer marginal region 10' of the tube sheet 7, which causes an at least partial covering of the tube sheet 7 relative to at least one inflow side 19, i.e. relative to the cooling air mass flow 11.

The additional element 18 can be designed as heat insulation 13 (see FIGS. 1 and 2) and/or as shielding element 14 (see FIGS. 3 and 4), which shields the outer edge 10 or the outer marginal region 10' of the tube sheet 7. Without the heat insulation 13 or without the shielding element 14, the outer edge 10 or the outer marginal region 10' of the tube sheet 7 is directly exposed to an impingement by headwind, so that the cooling air mass flow 11 resulting from the headwind cools to a different degree as a function of the speed of the motor vehicle 3, while the fold or web region 12, which divides the flat tube 5 into at least two different chambers, is exposed to an almost constant temperature, so that between the outer edge 10 or the outer marginal region 10' of the tube sheet 7 and the fold or web region 12 of the flat tube 5 a comparatively large temperature gradient would develop which, seen at least in the long term, has negative effects on the flat tube 5, in particular up to a breaking or tearing of the same. Through the additional element 18 provided according to the invention, for example the heat insulation 13 or the shielding element 14, this temperature gradient between the outer edge 10 or the outer marginal region 10' of the tube sheet 7 and the fold or web region 12 of the flat tube 5 can be reduced and thereby the thermal loads on the whole minimised.

The heat exchanger 1 is designed for example as a coolant radiator of an internal combustion engine 2 in a motor vehicle 3, wherein the coolant 9 on the inlet side of the heat exchanger block 4 has an (operating) temperature T>70°. "Operating temperature" should be understood merely to be the temperature after the cold starting phase or warm-up phase. Such a heat exchanger 1 can be referred to as high-temperature cooler. In particular at such coolant temperatures, paired with a headwind-induced cooling air mass flow 11, a high temperature gradient between the outer edge 10 or the outer marginal region 10' of the tube sheet 7 and the fold or web region 12 of the flat tube 5 can occur and be reduced by way of the additional element according to the invention.

The outer marginal region 10' is to mean the region of the tube sheet 7 which, circumferentially, projects over the cross section of the received stack of flat tubes 5 and heat exchanger elements 17, for example corrugated fins, fins. Eventually, the outer edge 10 is to mean the surface of the marginal region 10' that is accessible to the cooling air mass flow 11.

The heat insulation 13 is preferentially applied only in the region of the tube sheet 7, which is produced from a material having a similar heat conduction characteristic as the flat tubes 5 (for example aluminium). The tank 8 need not generally have to be additionally protected from the inflow since the same is mostly produced from plastic and thus does not contribute to the development of thermal stresses through a temperature differential to the fold or web region 12 of the flat tubes 5. In the case of an embodiment from a metallic material, such as for example aluminium, the tank 8 should likewise preferentially be protected by way of an insulation, which can be applied at least in the region that is accessible to the headwind. Obviously, an arrangement on the opposite side or circumferentially on the outer edge 10 or on the outer marginal region 10' can also be provided.

Here, the additional element 18 is preferentially exclusively arranged in a region which can be subjected to the direct inflow of the cooling air mass flow 11 and in particular is not already protected from direct inflow through already existing components. It is obviously clear that the heat insulation 13 or the shielding element 14 are arrangeable both cumulatively and also alternatively. Obviously, the additional element 18 according to the invention cannot only be employed with a high-temperature cooler, but also with a low-temperature cooler, in particular with a cold low-temperature cooler with low fin density, since the tube sheet 7 in this case can also be subjected to significant temperature changes.

The heat insulation 13 preferably consists of an open-pore or closed-pore foam material, for example a cellular material or another heat-insulating material, for example plastic. Here, the additional element 18, for example the heat insulation 13, is fastened to the outer edge 10 or outer marginal region 10' of the tube sheet 7 by means of bonding, clamping or by injection-moulding the heat insulation 13 onto the outer edge 10 or the outer marginal region 10' of the tube sheet 7. By way of this, a comparatively simple and thus also cost-effective installation of the heat insulation 13 on the tube sheet 7 can be achieved.

Figure 3:
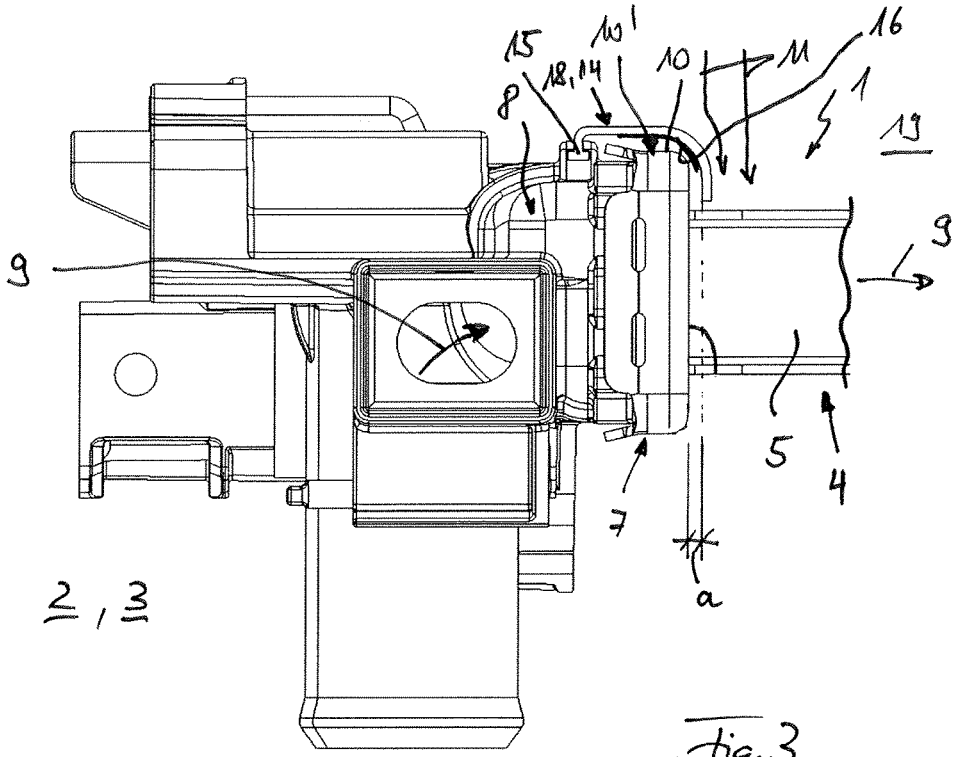
Figure 4:
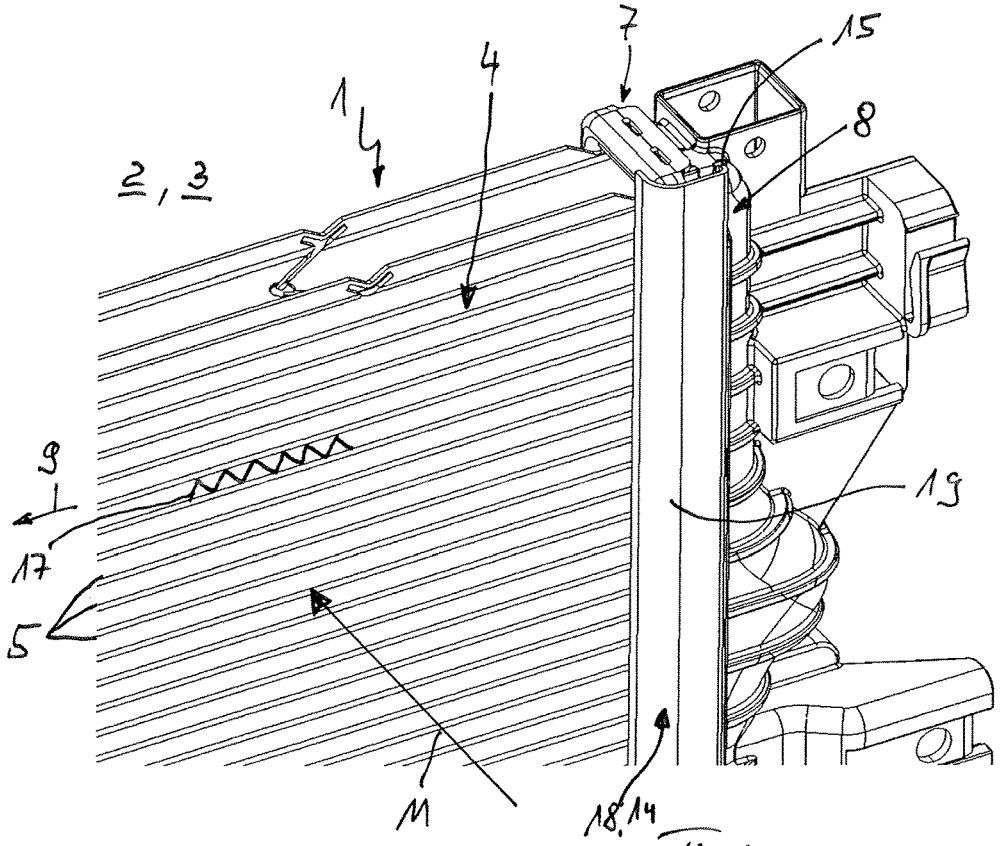
Figure 5:
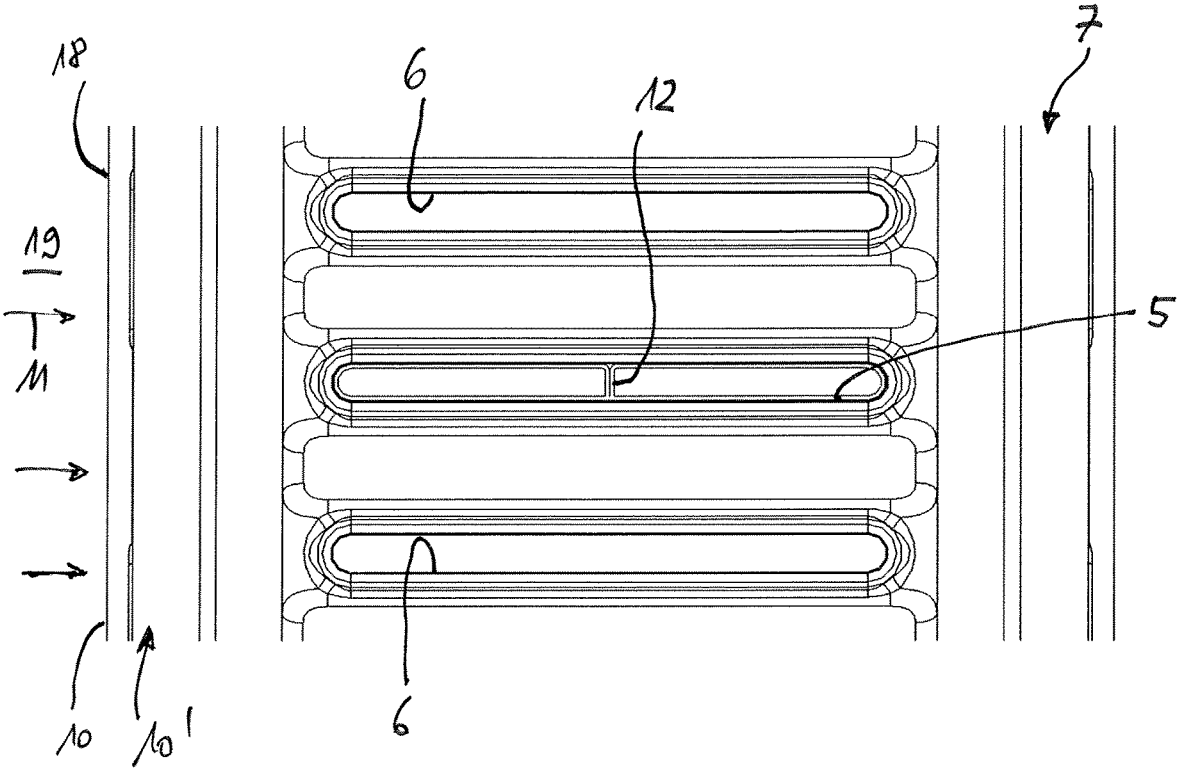

Viewing the embodiments according to FIGS. 3 and 4 it is evident that the additional element 18 shown there is a shielding element 14 that is connected to the tank 8 of the coolant header and projects over the outer edge 10 or the outer marginal region 10' of the tube sheet 7. In addition, the shielding element 14 is arranged spaced apart from the tube sheet 7, so that between the same, i.e. the outer edge 10 or the outer marginal region 10' and the shielding element 14 a heat-insulating air gap remains. The shielding element 14 can be formed for example as a plastic injection moulding. In addition, the shielding element 14 can be connected to the tank 8 by way of a plug connection 15 (see FIG. 3), here in the manner of an undercut connection, a snap-in connection, a bonded connection or a screwed connection.

Viewing FIGS. 3 and 4 further it is evident that the shielding element 14 also covers at least parts of the tank 8 and thereby also protects the same, at least at the transition to the tube sheet 7, from a direct inflow of headwind, i.e. the cooling air mass flow 11. In addition, the shielding element 14 can additionally or alternatively comprise a heat-insulating material on an inside facing the flat tubes 5 or the tube sheet 7, as a result of which the heat-insulating effect is additionally improved.

Between the flat tubes 5, heat exchanger elements 17 (see in particular FIGS. 2 and 4), in particular in the manner of corrugated fins, are additionally arranged which make possible an improved heat transfer between the coolants flowing in the flat tubes 5 and the headwind 11. The heat exchanger elements 17 are arranged spaced apart from the respective tube sheet 7 by a distance a (see FIG. 3), so that the heat exchanger elements 17 do not touch the tube sheet 7. Viewing now FIG. 3 it is evident that the shielding element 14 projects beyond the distance a into the heat exchanger block 4 and because of this covers a cooling air bypass that is present within this distance a because of the absent heat exchanger elements 17, so that the headwind 11 and thus the cooling airflow is preferentially conducted exclusively through those regions of the heat exchanger block 4, in which the heat exchanger elements 17 are actually arranged.

Alternatively it can obviously be also provided that the additional element 18, in particular the shielding element 14, exclusively covers the tube sheet 7 and does not or not substantially project beyond the heat exchanger block 4. Thus, the outer edge 10 or the outer marginal region 10' of the tube sheet 7 is thus exclusively protected from a direct inflow, without reducing the inflow of the cooling air mass flow 11 to the heat exchanger block 4 and thus the output of the heat exchanger 1.

In particular by way of an additional element 18 formed as shielding element 14, a flow control of the cooling air mass flow 11 can take place besides the reduction of the temperature gradient in such a manner that the same does not flow through a cooling air bypass near a tube sheet, as a result of which the output can be additionally increased.

Thus, the temperature gradient that occurs between an outer edge 10 or an outer marginal region 10' of the tube sheet 7 and the fold or web region 12 of the flat tubes 5 can be reduced in particular with the heat exchanger 1 according to the invention, as a result of which the thermal loads are significantly minimised and because of this the lifespan of the heat exchanger 1 can be extended.

The invention claimed is:

1. A heat exchanger of a motor vehicle that is supplied with a cooling air mass flow that changes dependent on a travelling speed, the heat exchanger comprising:

a heat exchanger block with a plurality of flat tubes that are each received on a longitudinal end side in an associated passage opening of a tube sheet and provide a coolant path, a tank connected to the tube sheet and define a coolant header, and an additional element arranged on an outer edge or on an outer marginal region of the tube sheet, wherein the additional element is structured and arranged to extend transversely to the tube sheet and provide an at least partial covering of the tube sheet relative to at least an inflow side.

2. The heat exchanger according to claim 1, wherein at least one of:

the additional element is a heat insulation, and the additional element is a shielding element that at least partly shields the outer edge or the outer marginal region of the tube sheet.

3. The heat exchanger according to claim 1, wherein the additional element is a heat insulation of an open-pore foam material or closed-pore foam material.

4. The heat exchanger according to claim 1, wherein the additional element is a heat insulation that is bonded, clamped or injection-moulded onto the tube sheet.

5. The heat exchanger according to claim 1, wherein the additional element is a heat insulation arranged circumferentially on the outer edge or on the outer marginal region of the tube sheet.

6. The heat exchanger according to claim 1, wherein the additional element is a shielding element that is connected to the tank of the coolant header and projects over the outer edge or the outer marginal region of the tube sheet, and wherein the shielding element is arranged spaced apart from the outer edge or the outer marginal region.

7. The heat exchanger according to claim 6, wherein the shielding element provided by the additional element is connected to the tank of the coolant header via a plug connection, a snap-in connection, a bonded connection, or a screw connection.

8. The heat exchanger according to claim 6, wherein the shielding element provided by the additional element is composed of plastic.

9. The heat exchanger according to claim 6, wherein at least one of:

the shielding element provided by the additional element covers at least part of the tank, and the shielding element provided by the additional element comprises a heat-insulating material on at least one of an inner side facing the plurality of flat tubes and the tube sheet.

10. The heat exchanger according to claim 6, wherein:

heat exchanger elements are arranged between the plurality of flat tubes, the heat exchanger elements are arranged spaced apart from the tube sheet by a distance, and the shielding element provided by the additional element projects over the distance beyond the heat exchanger block and covers a cooling air bypass disposed within the distance.

11. The heat exchanger according to claim 1, wherein the additional element covers the tube sheet without substantially projecting over the heat exchanger block.

12. A motor vehicle, comprising:

at least one heat exchanger that is supplied with a cooling air mass flow that changes depending on a travelling speed, the at least one heat exchanger including:

a heat exchanger block with a plurality of flat tubes that are each received on a longitudinal end side in an associated passage opening of a tube sheet and provide a coolant path, a tank connected to the tube sheet and define a coolant header, and an additional element arranged on an outer edge or on an outer marginal region of the tube sheet, wherein the additional element includes a shielding element that projects over the outer edge or the outer marginal region to provide an at least partial covering of the tube sheet relative to the cooling air mass flow, and wherein the shielding element is arranged spaced apart from the tube sheet such that an air gap is disposed between the shielding element and the outer edge or the outer marginal region.

13. The motor vehicle according to claim 12, wherein the at least one heat exchanger is a coolant radiator of an internal combustion engine.

14. The motor vehicle according to claim 12, wherein the at least one heat exchanger is a coolant radiator of an internal combustion engine and coolant on an inlet side of the heat exchanger block has a temperature T>70° C.

15. The motor vehicle according to claim 12, wherein the additional element is exclusively arranged in a region that can be subjected directly to an inflow the cooling air mass flow.

16. The motor vehicle according to claim 12, wherein the additional component further includes a heat insulation.

17. The motor vehicle according to claim 16, wherein the heat insulation is composed of an open-pore foam material or a closed-pore foam material.

18. The motor vehicle according to claim 12, wherein the shielding element is connected to the tank of the coolant header and projects over the outer edge or the outer marginal region of the tube sheet and extends transversely to the tube sheet.

19. The heat exchanger according to claim 1, wherein the additional element includes a plastic shielding element that projects over the outer edge or the outer marginal region, and wherein the shielding element is arranged spaced apart from the tube sheet such that an air gap is disposed between the shielding element and the outer edge or the outer marginal region.

20. A heat exchanger of a motor vehicle that is supplied with a cooling air mass flow that changes dependent on a travelling speed, the heat exchanger comprising:

a heat exchanger block with a plurality of flat tubes that are each received on a longitudinal end side in an associated passage opening of a tube sheet and provide a coolant path;

a tank connected to the tube sheet and define a coolant header; and an additional element arranged on an outer edge or on an outer marginal region of the tube sheet, wherein the additional element is structured and arranged to provide an at least partial covering of the tube sheet relative to at least an inflow side;

wherein the additional element includes a shielding element that is connected to the tank of the coolant header and projects over the outer edge or the outer marginal region of the tube sheet;

wherein heat exchanger elements are arranged between the plurality of flat tubes, and the heat exchanger elements are arranged spaced apart from the tube sheet by a distance; and wherein the shielding element projects over the distance beyond the heat exchanger block and covers a cooling air bypass disposed within the distance.

* * * * *